United States Patent [19]

Gall

[11] 4,333,584

[45] Jun. 8, 1982

[54] CONTAINER CLOSURE

[75] Inventor: John C. Gall, Chicago, Ill.

[73] Assignee: Sears, Roebuck and Co., Chicago, Ill.

[21] Appl. No.: 188,807

[22] Filed: Sep. 19, 1980

[51] Int. Cl.[3] ..... B65D 41/10; B65D 41/12; B65D 41/14

[52] U.S. Cl. ..... 220/309; 220/66; 220/67; 220/284

[58] Field of Search ..... 220/309, 66, 67, 284

[56] References Cited

U.S. PATENT DOCUMENTS 3,589,551 6/1971 Haggbom ..... 220/309

FOREIGN PATENT DOCUMENTS 943827 3/1949 France ..... 220/309
51983 1/1933 Norway ..... 220/309

*Primary Examiner*—George T. Hall
*Attorney, Agent, or Firm*—Arnstein, Gluck & Lehr

[57] ABSTRACT

A lockable closure for a container having a foldable annular wall advantageously has locking means whereby the closure can be releasably locked to the container. The closure has an annular bendable wall adapted to be disposed at least partially in contact with the annular wall of the container. The bendable wall has a reversely bent annular lip adapted to be disposed about the outer edge of the annular wall of the container. Upon the closure being disposed with its reversely bent annular lip disposed about the outer edge of the wall of the container, the bendable wall of the closure and its annular lip are deflectable with the foldable wall of the container to fold the bendable wall into and out of locking engagement with the foldable wall of the container. The closure is retained in either the locked or unlocked positions without additional forces or apparatus as it is substantially in a zero stress condition at these positions.

11 Claims, 5 Drawing Figures

CONTAINER CLOSURE

FIELD OF THE INVENTION

This invention relates to a closure for a container, and, more particularly, to a lockable closure, for example, a lid, which is releasably locked to a container having a foldable wall.

BACKGROUND OF THE INVENTION

Container and closure combinations presently known to the art generally consist of injection molded containers and lids wherein one or more lips or edges are molded into one component while mating grooves are molded into the other component. Locking of the closure to the container is commonly provided by diametral sizing so that the marginal edge of the lid must be stretched during engagement and the components snap into locked position. In the common arrangement, the one or more lips or edges and mating grooves require a negative draft in at least one set of molds and therefore necessitates longer chill times in the molding operation so that the material can be deformed while withdrawing the component from the mold. The degree of negative draft required is directly related to the holding power of the closure, that is, the higher the degree of negative draft and the difficulty in removing the component from the mold, the greater the security of the locking arrangement. Further, the more secure the locking arrangement the more difficult it will be for a user to remove the closure from the container. The difficulty in removing the closure is often objectionable for applications where ease of removal of the closure without the use of tools, is desirable.

In the case of containers for paint and similar substances, cylindrical metal cans have been the industry standard. While closures for these cans have been successfully designed, and the combination of can and closure or lid passes various tests, particularly the shipping drop test, the use of metal cans are objectionable both because of relatively expensive materials used therein and the inability to conveniently nest empty containers for economical shipping and storage. Attempts have been made to utilize molded plastic containers for paint and similar substances, but closures designed for such containers generally do not provide for positive locking of the closure to the container, and specifically, the combination of closure and container does not pass the test requirements, particularly the shipping drop test.

Therefore, one object of the present invention is to provide a lockable closure for a container in which the closure can be brought into and out of locking engagement with the container.

Another object of the present invention is to provide a closure which is applicable to containers of the molded plastic pail type which can be brought into and out of locking engagement with the container.

A further object of the invention is to provide a closure of simplified design producible by conventional molding methods with little or no negative draft, and which provides for locking of the closure to the container without supplemental locking means.

Still another object of the present invention is to provide a closure having means for sealing and locking the closure which does not require orientation of the closure with respect to the container.

A further object of the invention is to provide a lockable closure having self-retaining locking means which retains its unlocked or locked condition, and can be conveniently locked and unlocked by the user.

These and other objects and advantages of the present invention will be readily apparent to those skilled in the art from the following description.

SUMMARY OF THE INVENTION

In general, the objects and purposes of the invention are met by providing a closure having at least an annular bendable wall adapted to be disposed at least partially in contact with an annular foldable wall of a container defining an opening, with the bendable wall having a reversely bent annular lip adapted to be disposed about the outer edge of the annular wall of the container. Upon the bendable wall of the closure being disposed at least partially in contact with the annular wall of the container, and the reversely bent annular lip disposed about the outer edge of the wall of the container, the bendable wall and the annular lip of the closure are deflectable with the foldable wall of the container to fold the bendable wall of the closure into and out of locking engagement with the foldable wall of the container. Preferably the bendable wall and the annular lip of the closure are deflectable with the foldable wall of the container upwardly and downwardly along an arcuate path.

The closure of the present invention preferably includes a portion adjacent the bendable wall adapted to be disposed within an opening defined by the foldable annular wall of the container to provide additional sealing engagement with the container wall. It is further preferred that the portion adjacent the bendable wall of the closure is normally tapered and is deflectable upon the bendable wall of the closure being deflected upwardly or downwardly.

The closure of the present invention further preferably includes having the bendable wall and the portion adjacent thereto at differing angles from the vertical, with the wall preferably having a greater angle from the vertical than the lower wall portion. Most preferably, the wall and the portion taper conically upwardly and outwardly from the vertical, thus providing a portion of concentrated bendability at the annular junction of the bendable wall and the portion adjacent thereto.

The invention also includes the closure and container combination in which the container has an annular foldable wall and the closure has an annular bendable wall having a reversely bent annular lip as heretofore described, for providing the described locking arrangement. In addition, preferably the foldable wall of the container in the combination is conical and includes an annular portion having more concentrated foldability than the remainder of the wall, with the annular portion being adapted to be disposed adjacent an annular portion of the bendable wall of the closure, which similarly has more concentrated bendability than the remainder of the bendable wall, upon the closure being disposed with its reversely bent annular lip disposed about the edge of the foldable wall. In the last described preferred combination, the foldable wall together with the bendable wall are deflected into and out of locking engagement with each other.

The lockable closure of the present invention can be utilized with containers having a foldable annular wall manufactured of various materials and construction, for example plastic containers. The reference to "plastic" is understood to refer to polymeric material, and "plastic containers" to containers manufactured of polymeric material, for example, by molding such as by blow molding or injection molding. The container must have an annular foldable wall defining an opening to be closed by the closure of the present invention, but otherwise the shape and construction of the container is not of concern to the present invention.

The lockable closure of the present invention is preferably manufactured of plastic material to form a pliable closure, which may also be referred to as a lid. More preferably the closure is prepared by injection molding or blow molding of a pliable plastic material, such as polypropylene or polyethylene or similar plastic materials and mixtures of such materials. Closures of the present invention constructed of the described materials are relatively pliable and can be placed over and/or into the opening of the container with a portion of the closure in contact with the foldable annular wall of the container. In such position, the bendable wall of the closure and the foldable wall of the container are generally upturned and at zero stress. Upon applying a downward force to the adjacent walls, the walls will be deflected downwardly and outwardly causing the bendable wall and its lip to bend into locking engagement with the annular foldable wall of the container. During this deflection, the outer edges of the walls are subjected to increased internal tension, while the lower edges are subjected to lesser tension, causing the area of bending to deflect inwardly. The continuation of the application of the deflecting force to the walls causes the walls to assume a downwardly position, and the lower edges to return to their non-deflected position, where the walls are no longer under stress and the locking condition with the foldable wall of the container is retained until an external deflecting force is applied in an opposite, upward direction. The operation and construction of the closure of the present invention will be further understood from the following description of the drawings and preferred embodiments.

DETAILED DESCRIPTION

Figure 1:
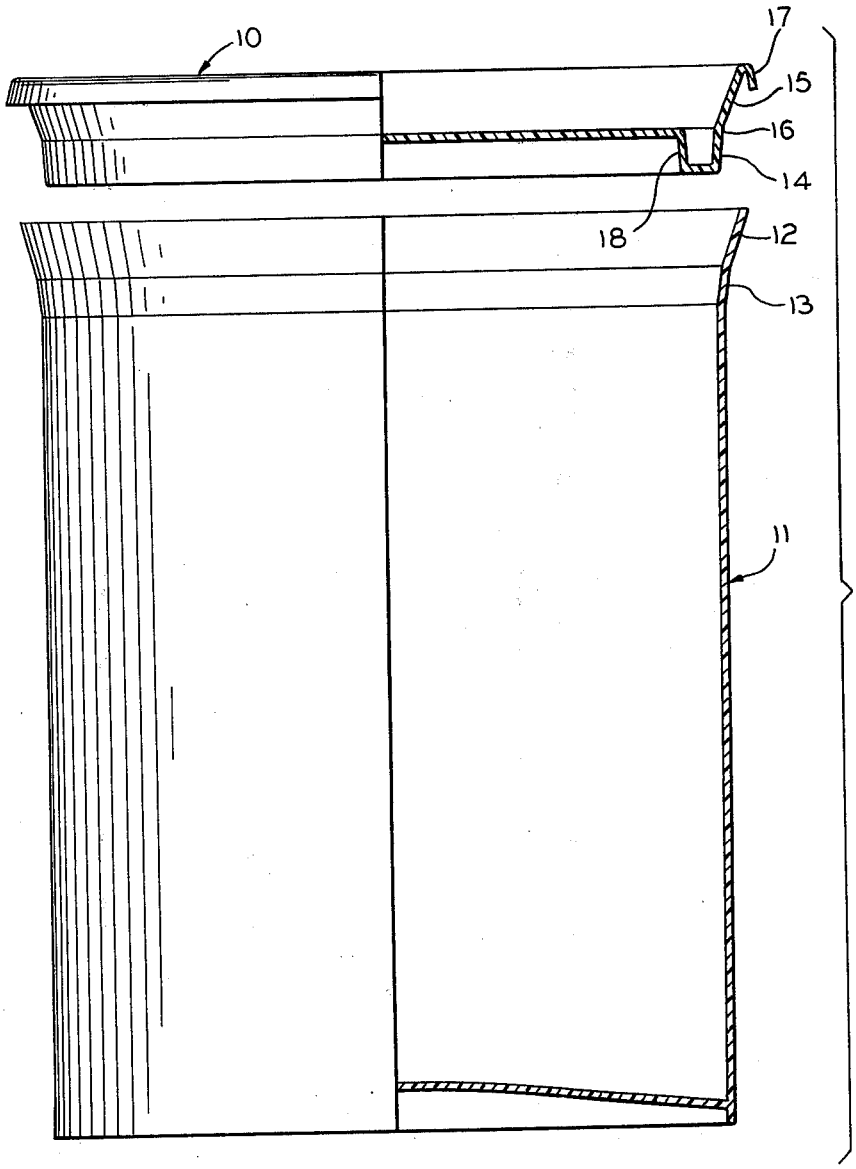
FIG. 1 is an elevational view, exploded and partly in section, of a closure in accordance with the present invention applied to a container with the closure in an open condition.

Referring to the drawings, the reference numeral 10 generally indicates a closure or lid in accordance with the present invention. Closure 10 is intended for use in closing and locking to a container 11 having an annular foldable wall 12. Container 11 can be formed of various materials, including plastic, as shown, and may be cylindrical or have a tapered side wall to facilitate nesting of a plurality of empty containers. In addition, container 11 may have a recessed bottom, as shown, to facilitate stacking of containers which have been closed and locked by closures 10 of the present invention. Container 11 preferably includes a conical annular wall portion 13, with the annular foldable wall 12 extending therefrom.

Closure 10 has an annular portion 14 adapted to be disposed in contact with wall portion 13 of container 11. Closure 10 further includes bending means extending from annular portion 14 for lockingly engaging annular wall 12 of container 11. In the embodiment shown, the bending means extending from annular portion 14 is an annular bendable wall 15 which is conical and adapted to bend about its lower edge 16 into locking engagement with foldable wall 12 of container 11, and a reversely bent annular lip 17, adapted to be disposed about the outer edge of wall 12.

Figure 2:
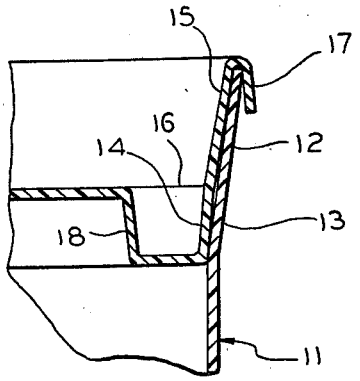
FIG. 2 is a fragmentary, sectional view of the closure and container illustrated in FIG. 1 with the closure in its unlocked condition.
Figure 3:
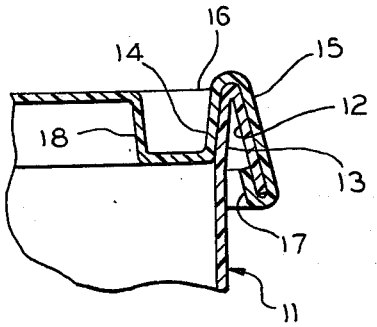
FIG. 3 is a fragmentary, sectional view of the closure and container illustrated in FIGS. 1 and 2 showing the closure in its locked condition.

In the embodiment shown in FIGS. 1–3, both bendable wall 15 of closure 10 and foldable wall 12 of container 11 are in the as-molded or zero internal stress condition. When deformed to the locked position shown in FIG. 3, both wall areas will contribute to the locking action as will be hereinafter described. In this locked condition both wall areas will be subject to internal stresses in the area of edge 16 which will bias the forces so that the unlocking force will be less than the locking force until internal stress relief occurs.

Closure 10 can include an annular well 18, positioned inwardly of annular portion 14 of which portion 14 is one wall and is adapted to contact wall portion 13. Upon contact of both annular portion 14 and bendable wall 15 of closure 10 with portion 13 and foldable wall 12 of container 11, respectively, at least two areas of sealing between closure 10 and container 11 are established.

Furthermore, in the embodiment shown in FIGS. 1–3, edge 16 of closure 10 is an annular portion of more concentrated bendability than the remainder of wall 15. Edge 16 may have more concentrated bendability by having a narrower cross-section than wall 15 or by being the annular junction in the wall immediately adjacent portion 14 and formed by the differing angles from the vertical of wall 15 and portion 14, with the wall 15 having a greater angle upwardly and outwardly from the vertical than the wall portion 14, as shown. Edge 16 serves as an area of pivoting or bending of the bending means as the latter is placed into and out of locking engagement with foldable wall 12 of container 11 upon deflection of wall 15 and lip 17, between its upwardly and downwardly positions.

Figure 5:
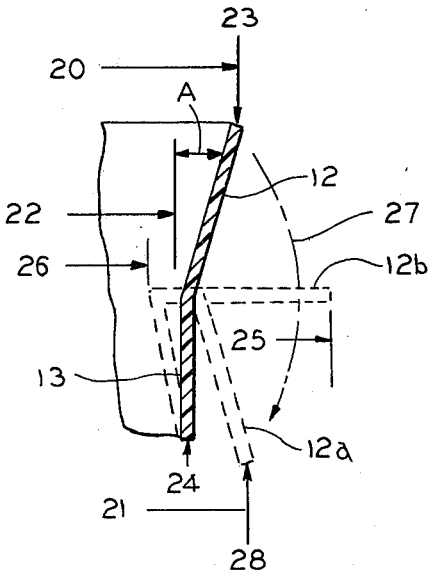
FIG. 5 is a fragmentary sectional view of a simplified structure of the present invention illustrating the principal of operation of the self-locking characteristics of the present invention in being placed from an unlocked to a locked condition.

Reference is made to FIG. 5 and also FIGS. 1–3, reference numerals in the latter being utilized in the simplified view of the former to describe similar elements, for the purpose of illustrating the principle of operation of the closure of the present invention. In FIG. 5, numerals 12 and 13 represent wall 12 and portion 13 of container 11, and can represent wall 15 and portion 14 of closure 10, as well. Arrow 20 indicates the position of the upper edge of wall 12 at its inwardly, unstressed position. As the walls are annular, the positions shown by horizontal arrows, such as 20, represent distances, for example diameters, if the walls are cylindrical, conical, and the like. Arrow 21 indicates the position of the edge of wall 12 at its lower position with the wall being shown in broken lines and designated by numeral 12*a*. Arrow 22 indicates the position of the lower limit of wall 12, i.e. at its junction with wall portion 13.

To commence the locking operation, a force is applied to the edge of wall 12, as indicated by arrow 23, with a reaction indicated by arrow 24. As the force applied at 23 increases, wall 12 will deflect downwardly and outwardly approaching the position indicated as 12*b*. During the application of force at 23, the upper portion of wall 12 is subjected to increased internal tension due to the increase in the diameter of wall 12 from the position indicated by arrow 20 to the position indicated by arrow 25. As the material of wall 12 is resilient, its lower or inner limit is forced into compression which tends to reduce the diameter thereof from the position indicated by arrow 22 to the position indicated by arrow 26.

Continued downward application of force as indicated by arrow 23 to the edge of wall 12, and hence beyond its position indicated as 12*b*, results in further movement of wall 12 along path 27 to a final, locked position indicated at 12*a*. At this position, the edge of wall 12 will be at the position indicated by arrow 21, at which the edge of wall 12 has the same diameter as the original diameter indicated by arrow 20, and wall 12 is unstressed, with its lower limit again at a position or diameter indicated by arrow 22. At this position, there is relatively little stress, i.e. only the stress from edge 16 being deformed, on wall 12 which would tend to cause the wall 12 to return to its unlocked position. It will be understood that the maximum stress conditions are reached when wall 12 is in position 12*b*, which position provides self-energized stress relief, conveniently termed snap action, by movement upwardly or downwardly along path 27 from position 12*b*.

In order to reverse the position of wall 12 from 12*a*, force is applied to wall 12, which is now in position 12*a*, in the direction indicated by arrow 28 to again cause wall 12 to be stressed and to be moved through position 12*b* and deflected so that its lower or inner limit (diameter) is deflected from position 22 to position 26. The deflection continues until wall 12 reaches the position indicated by the numeral 12 in FIG. 5, and the lower or inner limit of wall 12 again reaches the position or diameter indicated by numeral 22. As shown in FIG. 5, the force applied at 23 or 28 is a maximum at the unstressed condition, i.e. when wall 12 is as shown in FIG. 5 or at position 12*a*; and the applied force is at a minimum when wall 12 is at position 12*b*. The magnitude of the forces are thus a function of the angle between the position of the wall and the vertical, as indicated in FIG. 5 by the letter A.

It can be seen that representative wall 12 in FIG. 5 will perform in a similar manner as bendable wall 15 in FIGS. 1–3. However, the addition of lip 17 will add its resilient characteristics whereby in its locked position, similar to 12*a*, lip 17 will be in a position of lesser diameter causing it to be in compression. In assuming a position of minimal stress, the characteristics of the material will force lip 17 outward into restraining contact with foldable wall 12 of the container. The combination of all forces will result in a condition where the opening force, arrow 28, will be less than the locking force, arrow 23.

Considering that the walls and lip 17 are annular, the application of a single peripheral force to wall 15 and lip 17, and hence to wall 12 in the direction and at the point indicated by arrow 23, causes the portion of wall 12 beneath arrow 23 to move outwardly towards the position indicated by numeral 12*b*. In the movement of wall 12 to position 12*b*, the diametrically opposed portion of wall 12, is drawn inwardly. Concurrently, all circumferential points of wall 12 will be drawn inwardly in some degree resulting in an ovate shape of the outer edge of wall 12. The described movement reduces the force required to achieve the over center condition of wall 12 indicated by position 12*a*. The circumferential transfer of the force from the position indicated by arrow 23 progressively around wall 15 and lip 17 will progressively draw wall 12 from position 12*a* to a position inwardly of 12*a*. The ovate condition of the edge of wall 12 is similarly increased so that the opposed portion of wall 12 can be brought over center to a position corresponding to 12*a* where the angular relationship of all circumferential points will be equal and at zero or minimal internal stress, as illustrated by position 12*a*. Thus, it can be seen that a single movable force first applied at and in the direction indicated by arrow 23 for causing the closing and locking operation of the closure will be considerably less than a force applied to the entire periphery of wall 15 and lip 17. Similarly, a lesser single movable force need be applied to unlock the closure than an unlocking force applied to the entire periphery of wall 15 and lip 17.

Figure 4:
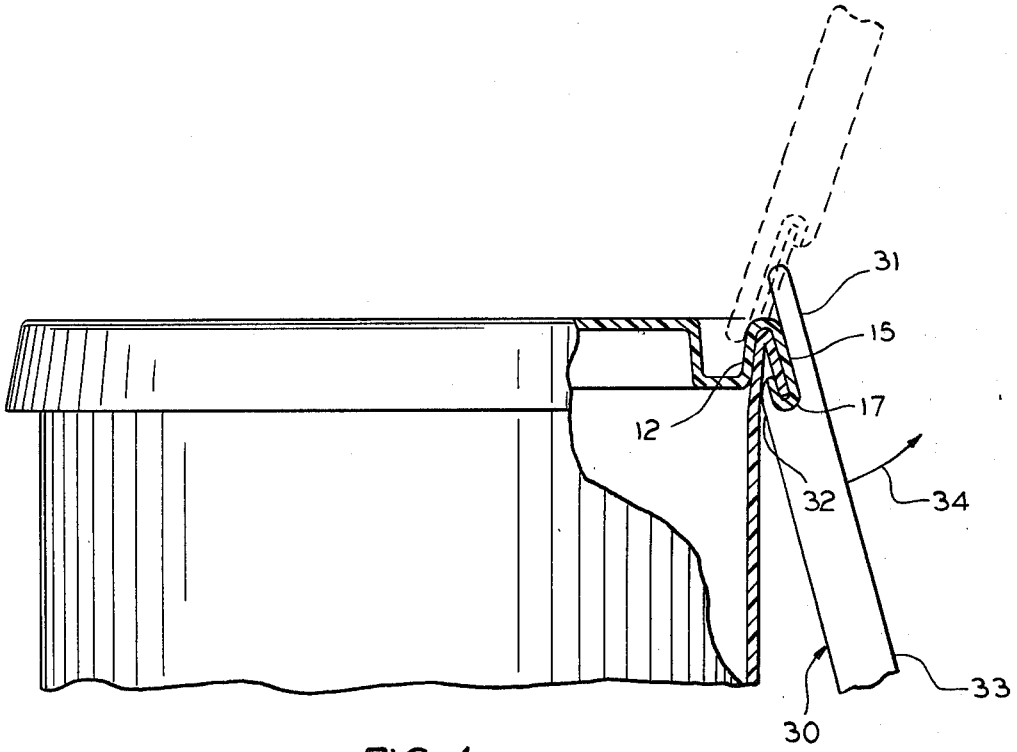
FIG. 4 is a fragmentary elevational view, partially in section, of the closure of the present invention showing the use of a tool to facilitate locking and unlocking of the closure, with the unlocked position being shown in broken line.

FIG. 4 illustrates the use of a tool 30 with the embodiment of the present invention shown in FIGS. 1–3, wherein similar elements are referred to by the same reference numerals. Tool 30 has a tined end, similar in shape to a bottle cap opener, having a lever portion 31 and a hook portion 32, and a handle end 33. To facilitate unlocking closure 10 from container 11, tool 30 is applied about lip 17 and wall 15 with the hook portion inserted between lip 17 and wall portion 13 of the container, and handle end 33 is rotated upwardly in the direction of arrow 34. The upward prying causes walls 12 and 15 to snap upward overcenter to the broken line position in the pried area. Successive lifting operations circumferentially about the container and closure, will unlock the closure. Relocking the closure can be accomplished as heretofore described manually or with the aid of tool 30.

It is seen from the foregoing that the closure of the present invention through its bending means, preferably in the form of an annular bendable wall and reversely bent lip, provides a mechanical leverage system which pivots the bendable wall into and out of locking engagement with the foldable wall of a container. In the locked or unlocked position, the closure is at a condition of zero or minimal internal stress, and hence is in a condition of maximum stability; whereas the closure is in a condition of maximum internal stress, and hence maximum instability, while the closure is being deflected from either its locked to its unlocked condition or from its unlocked to its locked condition. The closure provides an over-center snap action between the unlocked and locked conditions to facilitate locking and unlocking, and to retain the closure in either condition without the application of additional force or retaining means.

Various changes coming within the spirit of the invention may suggest themselves to those skilled in the art; hence the invention is not limited to the specific embodiments shown or described and uses mentioned, but the same is intended to be merely exemplary, the scope of the invention being limited only by the appended claims.

I claim:

1. A closure for a container having a foldable resilient annular wall defining an opening comprising a bendable resilient annular wall adapted to be disposed at least partially in contact with the foldable wall of the container, said bendable wall of said closure having a reversely bent annular lip disposed about the outer edge of the foldable wall of the container when said closure is disposed with said bendable wall of said closure at least partially in contact with the foldable wall of the container, said bendable wall of said closure and the foldable wall of the container being reversably movable together between an unlocked position and a locked position upon application of force sufficient to achieve over-center snap action when said closure has said reversely bent lip disposed about the outer edge of the wall of the container, whereby said bendable wall of said closure may be repeatedly moved into and out of locking engagement with the foldable wall of the container.

2. The closure as defined in claim 1, wherein said closure has a portion adjacent said bendable wall adapted to be disposed within the opening defined by the foldable wall of the container.

3. The closure as defined in claim 2, wherein said portion adjacent said bendable wall includes an annular well having an outer wall which is deflectable upon moving said bendable wall into and out of locking engagement with the foldable wall of the container.

4. The closure as defined in claim 1, wherein said bendable wall is tapered conically and includes an annular portion having greater bendability than the remainder of said wall.

5. The closure as defined in claim 4, wherein said portion of greater bendability comprises an annular junction in said bendable wall between upper and lower wall portions of differing angles from the vertical, with said upper wall portion having a greater angle from the vertical than said lower wall portion.

6. The closure as defined in claim 1, wherein said bendable wall and said annular lip are movable with the foldable wall of the container upwardly and downwardly along an arcuate path, said over-center snap action taking place substantially at the mid-point of said arcuate path.

7. A container and closure combination comprising a container having a foldable resilient annular wall defining an opening and a closure having a bendable resilient annular wall adapted to be disposed at least partially in contact with said foldable wall of said container, said bendable wall of said closure having a reversely bent annular lip disposed about the outer edge of said foldable wall of said container upon said bendable wall of said closure being at least partially in contact with said foldable wall of said container, said foldable wall of said container and said bendable wall of said closure being reversably movable together between an unlocked position and a locked position upon application of force sufficient to achieve over-center snap action when said closure has said reversely bent lip disposed about the outer edge of the wall of the container, whereby said bendable wall of said closure may be repeatedly moved into and out of locking engagement with said foldable wall of said container.

8. The container and closure combination as defined in claim 7, wherein said closure has a portion adjacent said bendable wall adapted to be disposed within said opening defined by said foldable wall of said container.

9. The container and closure combination as defined in claim 8, wherein said portion of said closure adjacent said bendable wall includes an annular well having an outer wall which is deflectable upon moving said bendable wall of said closure and said foldable wall of said container into and out of locking engagement with each other.

10. The container and closure combination as defined in claim 7, wherein said bendable wall is tapered conically and includes an annular portion having greater bendability than the remainder of said wall.

11. The container and closure combinations as defined in claim 10, wherein said foldable wall of said container is tapered and includes an annular portion having greater foldability than the remainder of said wall, said annular portion of said foldable wall being adapted to be disposed adjacent said annular portion of said bendable wall upon said said closure being disposed with said reversely bent annular lip disposed about the outer edge of said foldable wall, whereby upon moving said bendable wall with said annular portion of greater bendability being disposed adjacent said annular portion of greater foldability of said foldable wall, said foldable wall together with said bendable wall are moved with over-center snap action into and out of locking engagement with each other.

* * * * *